US009783969B2

(12) United States Patent
Lucas

(10) Patent No.: US 9,783,969 B2
(45) Date of Patent: Oct. 10, 2017

(54) BATHROOM FITTINGS

(75) Inventor: Tim Lucas, Queensland (AU)

(73) Assignee: ART PLASTICS PTY LTD, New South Wales (AU)

( * ) Notice: Subject to any disclaimer, the term of this patent is extended or adjusted under 35 U.S.C. 154(b) by 96 days.

(21) Appl. No.: 14/421,723

(22) PCT Filed: Aug. 14, 2012

(86) PCT No.: PCT/AU2012/001037

§ 371 (c)(1),
(2), (4) Date: Feb. 13, 2015

(87) PCT Pub. No.: WO2014/026214

PCT Pub. Date: Feb. 20, 2014

(65) Prior Publication Data

US 2015/0233102 A1 Aug. 20, 2015

(51) Int. Cl.
*E03C 1/23* (2006.01)

(52) U.S. Cl.
CPC ..... *E03C 1/23* (2013.01)

(58) Field of Classification Search
CPC ..... E03C 1/23; E03C 1/2302
USPC ..... 4/688, 689, 684, 683
See application file for complete search history.

(56) References Cited

U.S. PATENT DOCUMENTS 3,366,980 A * 2/1968 Forgie ..... A47K 1/14 338/22 R
3,428,295 A * 2/1969 Jones ..... F16K 31/528 251/144
4,276,662 A 7/1981 Young
5,819,328 A * 10/1998 Lewis ..... A47K 1/14 137/42
6,195,819 B1 * 3/2001 Wang ..... A47K 1/14 4/287
8,499,376 B2 * 8/2013 Kyung Kim ..... E03C 1/2306 4/287
9,151,027 B2 * 10/2015 Lucas ..... E03C 1/2302
2006/0195976 A1 9/2006 McAlpine
2012/0102640 A1 5/2012 Lucas

FOREIGN PATENT DOCUMENTS

FR 2600692 12/1987
GB 2373182 9/2002

OTHER PUBLICATIONS

International Search Report dated Oct. 17, 2012 for corresponding international patent application No. PCT/AU2012/001037.
Written Opinion dated Oct. 17, 2012 for corresponding international patent application No. PCT/AU2012/001037.
International Preliminary Report on Patentability dated Feb. 17, 2015 for corresponding international patent application No. PCT/AU2012/001037.

* cited by examiner

*Primary Examiner* — Huyen Le
(74) *Attorney, Agent, or Firm* — Abelman, Frayne & Schwab

(57) ABSTRACT

A bath or basin waste having a plug in which the upper face of the cap is substantially bellow the upper face of the bottom of the bath or basin to which it is fitted when in the closed position and substantially flush with the upper face of the bottom of the bath or basin when in the open position.

14 Claims, 6 Drawing Sheets

BATHROOM FITTINGS

CROSS REFERENCE TO RELATED APPLICATIONS

This application is a national phase of PCT application No. PCT/AU2012/001037, filed Aug. 14, 2012, which is incorporated herein by reference thereto.

FIELD OF THE INVENTION

This invention relates to fittings for bathroom facilities and in particular fittings commonly known as bath or basin outlets or wastes.

BACKGROUND OF THE INVENTION

One well known basic type of bath and basin waste has an externally threaded tube defining a flow passage therethrough from its upper end to its lower end and which is adapted to fit into the drain opening provided in a bathtub or basin. A flange extends outwardly from the tube at its upper end and is arranged to engage the upper face of the bath or basin bottom about the drain opening. Typically, a flat rubber washer is fitted about the tube between the flange and the basin and a nut is screwed onto the tube so as to engage the lower face of the basin bottom and tighten the flange against the washer so that it forms a watertight seal therebetween. A trap or pipe is then connected to the lower end of the tube and in turn connected to a waste water drainage pipe which eventually is connected to the sewerage system. A grate is usually fitted in the tube adjacent the flange and is often cast therewith to prevent passage of cakes of soap, cloth and the like. Sometimes the grate is formed separately and is secured in the tube by a screw which is screwed into the centre of intersecting a diametral cross bars which are cast in the tube (commonly known as a "spider"). The upper end portion adjacent the flange is usually tapered inwards away from the upper end to accommodate a removable tapered plug therein for closing the flow passage.

A more recent type of basin outlet commonly referred to as a "pop-up" waste or outlet has become popular because it does not require a separate plug. Such basin outlets typically have a tube and flange similar to the basic bath and basin outlet described above but instead of a removable plug being used to close the flow passage, a cap is mounted in the flow passage adjacent the flange for up and down movement between an open position and a closed position so as to close the passage when it is down and open the passage when it is up.

In such known pop-up type outlets the cap seals against the flange or the inner face of the tubular portion immediately adjacent the upper end when down to close the passage and is spaced above the flange when up thereby opening the passage at its upper end. Movement of the cap is controlled by an actuation device to which the cap is connected such that closing of the passage is achieved by pushing the cap down against a spring loaded catch and released by pushing the cap further down to release the catch so that it rises to the open position under the force of a spring. In such pop-up type basin wastes, the upper face of the cap is normally flush with the flange (and the upper face of the basin bottom) when the cap is down in the closed position but protrudes significantly above the flange (and the basin bottom) when in the open position.

It will be appreciated that a large number of persons who use a wash basin to quickly wash their faces and hands or clean their teeth prefer to do so with running water direct from the basin faucet while the basin outlet is open and water can flow directly out of the basin. Unfortunately, the protruding cap of the presently available basin wastes can be a nuisance in such cases. Furthermore, the basin waste is typically more aesthetically pleasing when in the closed position than the open position but is rarely in the closed position and many people prefer to leave the basin waste open when not in use so that any drips drain away rather than overflow the basin.

A new type of bath or basin waste is described and illustrated in U.S. application Ser. No. 13/283837 to the present applicant which has some of the advantages of the pop-up type waste but which does not significantly protrude into the basin when in the open position. Bath and basin wastes according to that application are illustrated in FIGS. 1 to 8 of this application ("the earlier version"). One difficulty with the earlier version is that because the cap is flush with the flange when in the open position and below the flange when in the closed position, it is difficult to service the actuating mechanism and replace seals.

SUMMARY OF THE INVENTION

The present invention is aimed at providing an improved bath or basin waste in which the cap is below the upper face of the flange when in the closed position and substantially flush with the upper face of the flange when in the open position and which can be easily serviced. The invention is also aimed at providing a bath or basin waste which more accurately keeps the plug centered when in the open position.

In one aspect, the invention resides broadly in a bath or basin waste, including:

a tube defining a flow passage with an inlet at its upper end and an outlet at its lower end, said tube terminating at its upper end in an outwardly extending flange;

a plug mounted in the flow passage for up and down movement between an open position in which the plug is up and a closed position when it is down, the plug having an upper face which is substantially flush with the upper face of the flange when in the open position and below the upper face of the flange when in the closed position; and actuation means mounted in the flow passage and connected to the plug for actuating movement of the plug relative to the tube between the closed position and the open position and wherein the plug is retained in the flow passage only by gravity.

In yet another aspect, the invention resides broadly in a bath or basin waste, including:

a tube defining a flow passage with an inlet at its upper end and an outlet at its lower end, said tube terminating at its upper end in an outwardly extending flange having an upper face and a lower face;

a plug mounted in said tube for up and down movement between an open position in which water can flow through the flow passage between said plug and said tube and a closed position in which flow between said plug and said tube is prevented, said plug having an upper face which is substantially flush with the upper face of said flange when in the open position but below the upper face of said flange when in the closed position; and actuation means mounted in the flow passage and operatively connected to said plug for actuating movement of said plug relative to said tube between the closed position and the open position; and wherein said plug is retained in said tube only by gravity.

Preferably, the plug is adapted to sealably engage with the inner face of the tube to close the flow passage when in the closed position and to disengage from the inner face when in the open position so as to allow water to flow through the flow passage. In a preferred form, the plug includes an outwardly extending circumferential flange which engages with a circumferential flange extending inwardly from the inner face of the tube when in the closed position thereby closing the flow passage. In such case, it will be appreciated that an annular passage is formed between the two flanges when the plug is in the open position but the annular passage is closed by engagement of the two flanges. In such form, it is preferred that said plug include outwardly extending guide means arranged to guide movement of the plug in generally linear up and down movement relative to the tube. In such arrangement, it is preferred that the actuation means be connected to the plug in a relatively free floating manner so as to accommodate any lateral forces which might be applied to the plug by the actuating means to prevent the plug binding with the tube. However, other suitable arrangements are possible, for example, the plug may include a flange adapted to engage the inner face of the tube when in the closed position and a circumferential recess may be formed in the tube so that the flange is disengaged when aligned with the recess.

Preferably, the plug includes a sealing component and a separate top cap component, the top cap component together with the tube defining a space therebetween through which water can flow. In such form, it is preferred that the space be an annular space so that water can flow all around the cap when in the open position. It is also preferred that the cap have a skirt depending therefrom with the cap being connected to the sealing component via the skirt. In one such form the cap is screwed onto the sealing component while in another form the cap is pushed onto the sealing component so that it can easily be removed to facilitate replacement of the actuation means.

Preferably, the actuation means includes a spindle which is slidably mounted to the tube and the plug is slidably mounted on the spindle. In such form, it is preferred that the plug be opened and closed by pushing down on the plug against a spring in the actuation means. In still yet another aspect, the invention resides broadly in a bath or basin waste, including:

a tube defining a flow passage with an inlet at its upper end and an outlet at its lower end, said tube terminating at its upper end in an outwardly extending flange having an upper face and a lower face and said tube having a bridge extending across said flow passage intermediate said upper and lower ends;

a plug assembly mounted in an operative position in said flow passage, said plug assembly including a plug arranged for up and down movement relative to said tube between an open position in which said plug is up and a closed position in which it is down, said plug including an upper face which is substantially flush with the upper face of the flange when in the open position and below the upper face of the flange when in the closed position at least adjacent its periphery, said assembly further including actuation means mounted in said flow passage and connected to said plug for actuating movement of said plug relative to said tube between the closed position and the open position, said plug assembly being engaged with said bridge such that in use it is retained in its operative position only by gravity whereby it can be removed from said flow passage by lifting it from said bridge.

In still yet another aspect, the invention resides broadly in a bath or basin waste, including:

a tube defining a flow passage with an inlet at its upper end and an outlet at its lower end, said tube terminating at its upper end in an outwardly extending flange having an upper face and a lower face and said tube having a bridge extending across said flow passage intermediate said upper and lower ends;

a plug assembly mounted in an operative position in said flow passage, said plug assembly including a plug arranged for up and down movement in said flow passage between an open position in which said plug is up and a closed position in which it is down, and said plug assembly further including actuation means connected to said plug for actuating movement of said plug relative to said tube between the closed position and the open position, said plug assembly being engaged with said bridge such that in use it is retained in its operative position only by gravity whereby it can be removed from the flow passage by lifting it from said bridge.

In this specification the bath or basin waste has been described in its normal in use position when fitted to a bath or basin drain and terms such as "vertical", "upper", "lower" and the like relative terms have been used to reference parts from that perspective. However, it is to be understood that such terms are not intended to limit use of the bath or basin waste to any particular orientation.

BRIEF DESCRIPTION OF THE DRAWINGS

In order that the invention may be more readily understood and put into practice, reference will now be made to the accompanying drawings wherein.

DETAILED DESCRIPTION OF THE INVENTION

Figure 1:
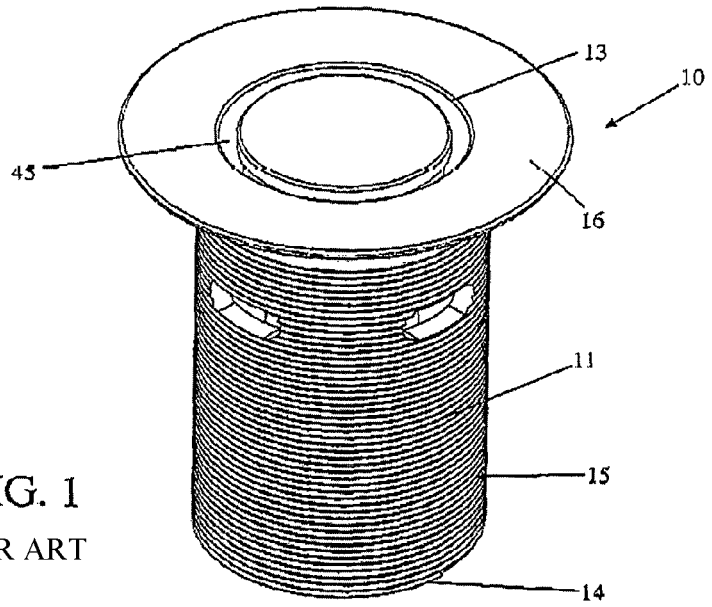
FIG. 1 PRIOR ART
FIG. 1 is an isometric view of a basin waste according to the earlier version with the plug in the open position.

The basin waste 10 illustrated in FIGS. 1 to 8 includes a tube 11 defining a passage 12 therethrough with an inlet opening 13 at its upper end, an outlet opening 14 at its lower end, and a flange 16 extending outwardly from the tube adjacent its upper end. The outer face of the tube is threaded as shown at 15 for screw threadedly receiving a nut thereon for securing the waste in the drain outlet of a wash basin with a flat rubber washer fitted about the tube between the flange and the basin to form a watertight seal therebetween.

Interconnecting diametral cross member 17 bridges the passage towards its lower end to provide a mount for a plug assembly 21 which is mounted thereto as will be described in more detail later.

Figure 2:
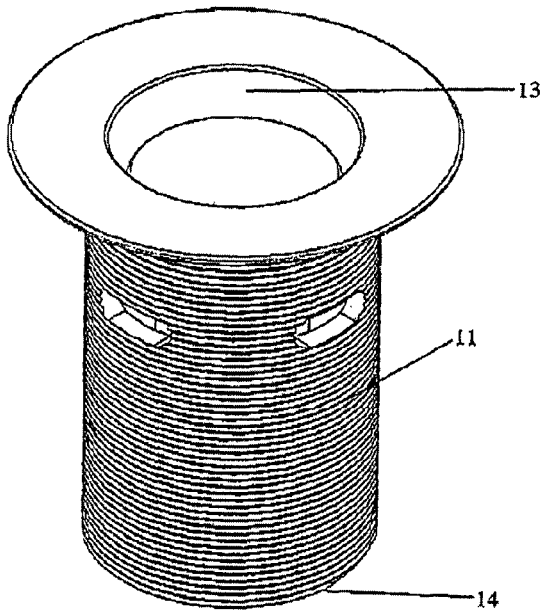
FIG. 2 PRIOR ART
FIG. 2 is an isometric view of the basin waste of FIG. 1 with the plug in the closed position.
Figure 3:
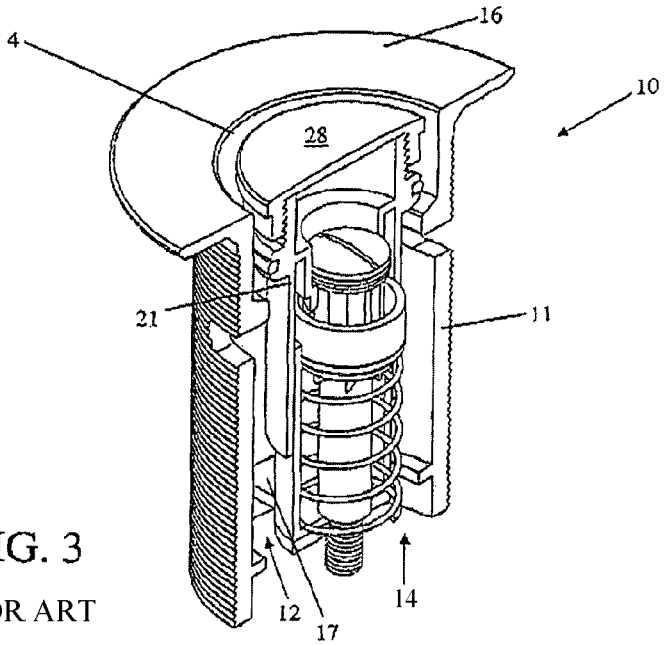
FIG. 3 PRIOR ART
FIG. 3 is a sectional isometric view of the basin waste of FIG. 1 along a diametral vertical plane with the plug in the open position.
Figure 4:
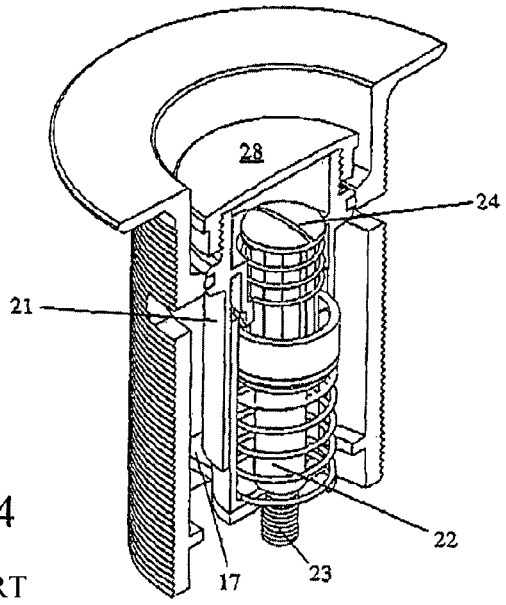
FIG. 4 PRIOR ART
FIG. 4 is a sectional isometric view of the basin waste of FIG. 1 along the same diametral vertical plane as FIG. 3 with the plug in the closed position.
Figure 5:
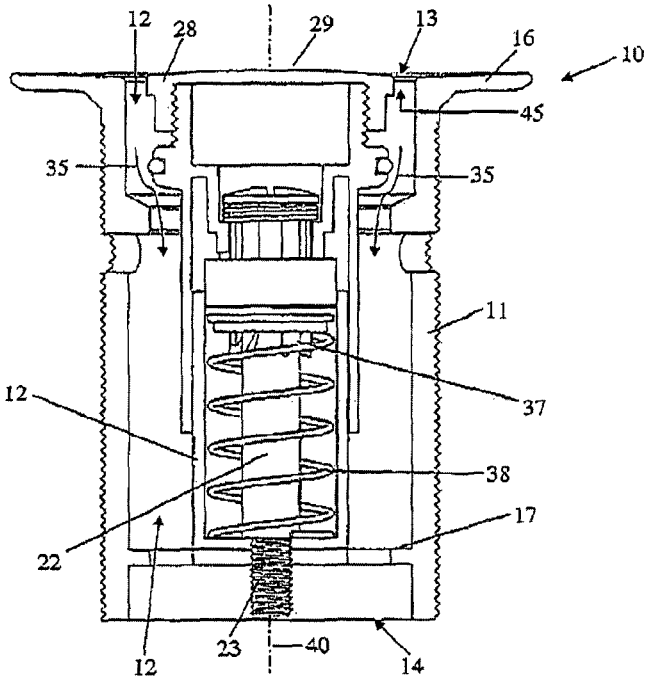
FIG. 5 PRIOR ART
FIG. 5 is a sectional elevation of the plug of FIG. 1 along a diametral plane with the plug in the open position.
Figure 6:
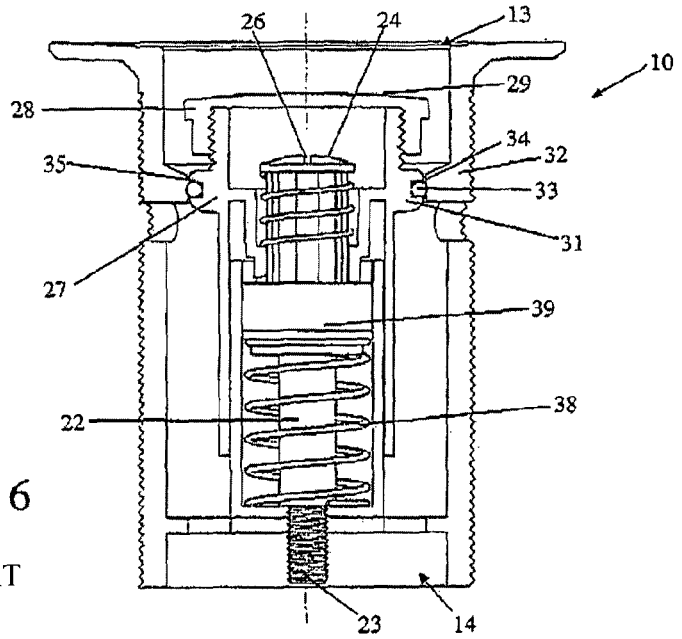
FIG. 6 PRIOR ART
FIG. 6 is a sectional elevation of the plug of FIG. 1 along a diametral plane with the plug in the closed position.
Figure 7:
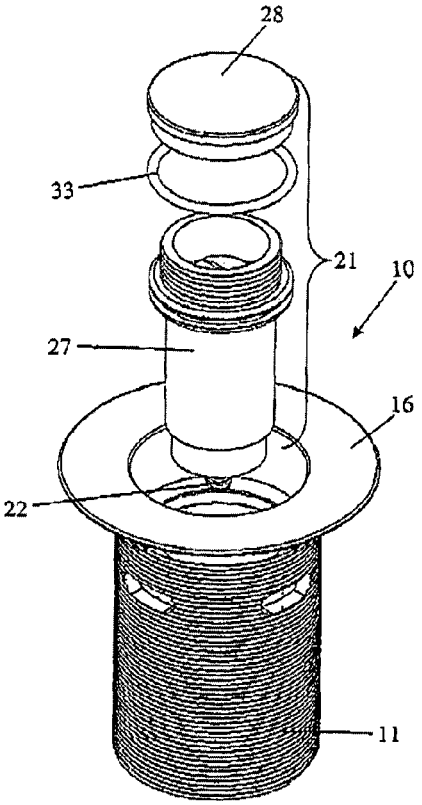
FIG. 7 PRIOR ART
FIG. 7 is an isometric view of the basin waste of FIG. 1 with the plug in line for assembly with the actuation device and with the actuation device in line for assembly with the tube of the basin waste.
Figure 8:
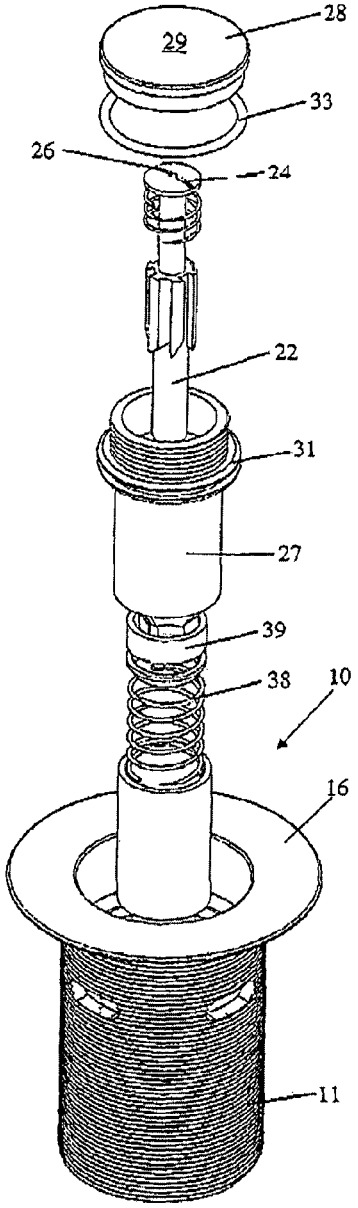
FIG. 8 PRIOR ART
FIG. 8 is an isometric view of the basin waste of FIG. 1 with all components in line for assembly.
Figure 9:
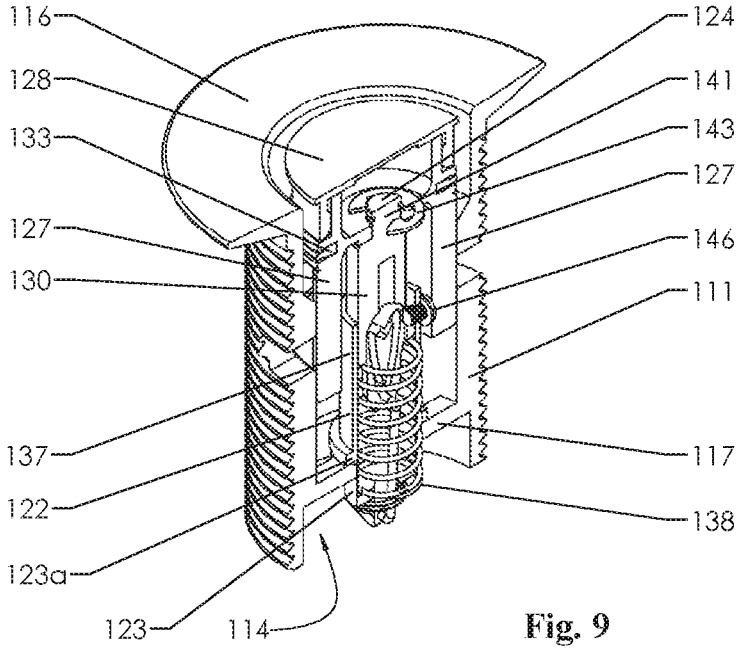
FIG. 9 is a sectional isometric view of a basin waste according to the present invention along a diametral vertical plane with the plug in the open position.
Figure 10:
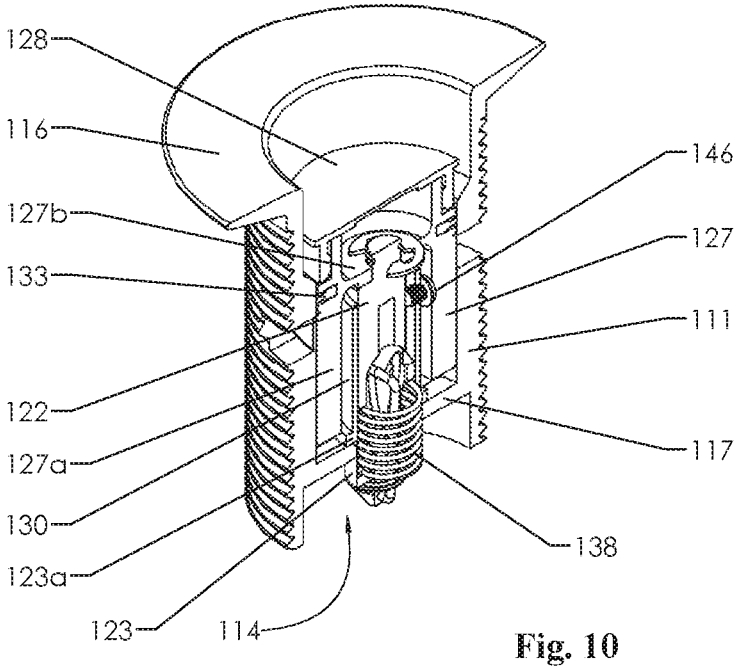
FIG. 10 is a sectional isometric view of the basin waste of FIG. 9 along the same diametral vertical plane as FIG. 9 with the plug in the closed position.
Figure 11:
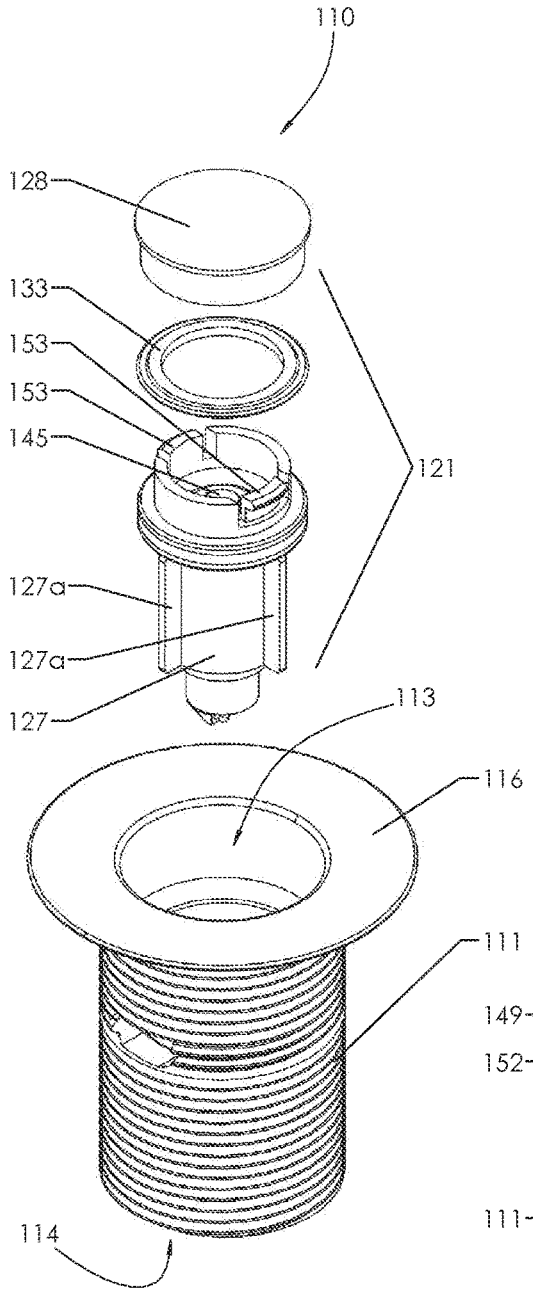
FIG. 11 is an isometric view of the basin waste of FIG. 9 with the plug assembly having sealing component, the top cap and its sealing washer in line for assembly and the entire plug assembly in line for assembly with the tube.
Figure 12:
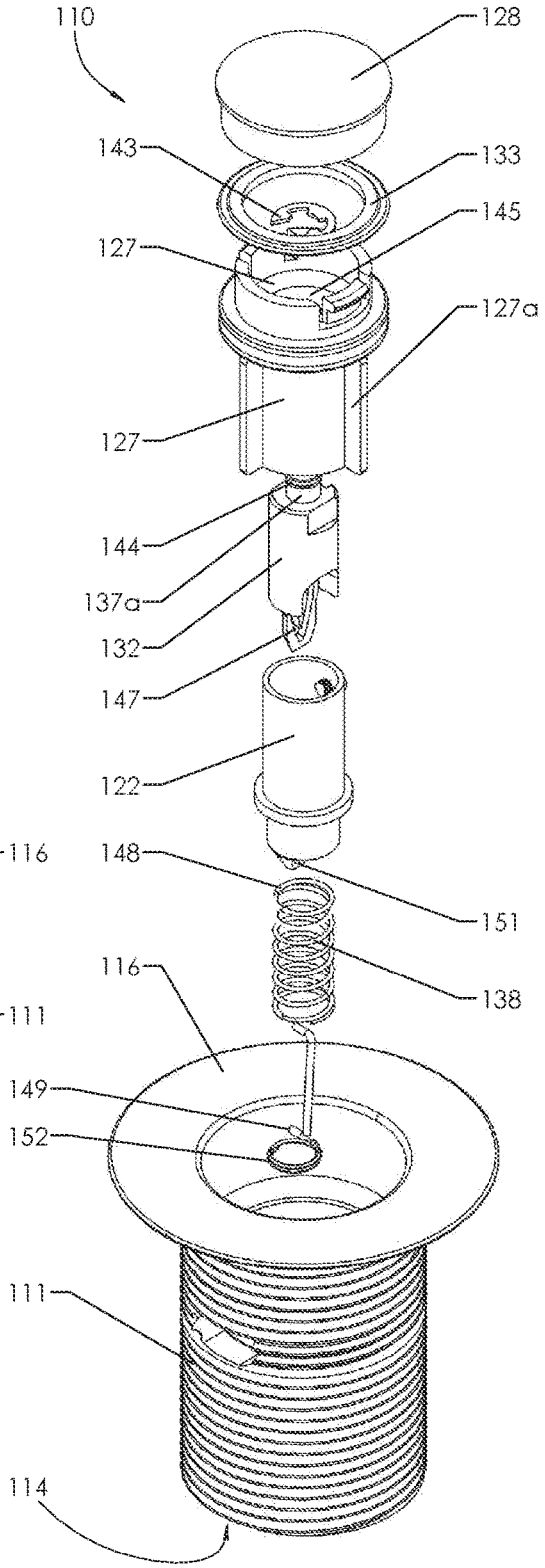
FIG. 12 is an isometric view of the basin waste of FIG. 9 with all components in line for assembly.

The plug assembly 21 includes a spindle 22 having a screw thread 23 at its lower end and a round head 24 with a screwdriver slot 26 therein at its upper end. A movable plug 27 is slideably mounted on the spindle for selective up and down movement relative thereto between an upper position as shown in FIGS. 1, 3 and 5 and a lower position as shown in FIGS. 2, 4 and 6. Suitably, a removable top cap 28 is screw threadedly mounted on the moveable plug at its upper end and as can be seen in the drawings, the top of the top cap is flush with the upper face of the flange 16 when in the up position and is below the level of the flange when in the down position. Suitably, the moveable plug 27 includes an outwardly extending flange 31 which sealingly engages the cylindrical face 34 of an inwardly extending flange 32 via O-ring 33 which is mounted in an O-ring groove 35 provided in the cylindrical outer face of the plug flange 31.

As can be seen in FIG. 5, when the moveable plug 27 is in the up position, the plug flange 31 is spaced from the tube flange 32 so as to form an angular flow passage 35 therebetween and when the moveable plug is in the down position, the plug flange engages with the tube flange via the O-ring 33 to close the angular passage.

The moveable plug is actuated by an "indexing" type actuator 37 of known type as used in the "pop-up" type basin outlets referred to earlier. The indexing actuator is arranged to allow the movable plug to be pushed down against the bias of spring 38 to catch in the closed position and to be released by again pushing the cap down so as to cause the collar 39 to index angularly about vertical axis 40 so as to release the plug and allow it to rise to the open position under the force of spring 38 in much the same manner as occurs in relation to the pop-up basin wastes previously referred.

Advantageously, it will be appreciated that the basin waste 10 is aesthetically pleasing from the top when in the open position with the upper face 29 of cap 28 being substantially flush with the upper face of flange 16 and showing an annular opening 45 between the top of the plug and the flange. The waste is also aesthetically pleasing when in the down (closed) position with the top of the plug forming an attractive "bottom" to the passage 12 in the tube 11.

It will be appreciated that access to the indexing mechanism can be gained by unscrewing the cap 28 whereupon the indexing mechanism can be unscrewed with a screwdriver if replacement of the indexing actuator is required.

The basin waste 110 illustrated in FIGS. 9 to 12 is similar to the one illustrated in FIGS. 1 to 8 in many respects and accordingly the same reference numbers will be used to refer to corresponding items except prefaced by a "1".

In basin waste 110, the plug assembly 121 includes an actuating mechanism 137 which has an inner shaft 130 and an outer sleeve 122, both formed of brass with the inner shaft being slidably mounted on the outer sleeve with the shaft and the sleeve biased apart in known manner by a compression spring 138 having the lower end 149 secured to the sleeve at lateral hole 151 and retained therein by a circlip 152 and the upper end 148 passing through a hole in tongue 147 of the shaft with the shaft and sleeve being secured together by a screw 146.

The tube 111 in basin waste 110 is identical to the tube 10 of the earlier basin waste except that the bridge 117 has a non-threaded bore 123*a* which is adapted to slidably receive therein the complementary lower end portion of the actuating mechanism 137 so that the whole plug assembly 121 can be removed and replaced from above without removing the tube 111 from the basin. That is to say, in such form, the plug assembly is retained in its operative position only by gravity acting on itself. Suitably, the outer sleeve 122 has a collar spaced from its lower end which forms a shoulder adapted to engage with the upper face of the bridge about the bore 123*a* to limit engagement of the outer sleeve (and thereby the plug assembly) in the tube. In other embodiments the end portion of the sleeve has a circlip groove provided therein and below the collar in cases where it is desirable to have the plug assembly securely retained in the tube by a circlip fitted to the collar on the underside of the bridge.

Advantageously, the sealing plug component is secured to the inner shaft 130 by way of the upper end portion 137*a* of the shaft extending through a centre hole 145 formed in the upper wall 127*b* of the sealing plug component and being secured thereto by a circlip 143 engaging in circlip groove 144 above the upper wall. Advantageously, the end portion 137*a* is a loose fit in the hole 145 so that the sealing plug 121 has limited lateral pivoting movement relative thereto which allows the sliding plug to align itself in the tube. In that respect, the sealing plug includes four equi-angularly spaced ribs or fins 127*a* which are adapted to slidably engage within the inner face of tube 111 so as to maintain alignment against lateral forces applied by the spring 138 with the spaces between the ribs providing a passage for water flow.

The actuating mechanism 137 operates in much the same manner as actuator 37 which is known to be used in the "pop-up" type basin outlets referred to earlier with the movable plug being pushed down against the bias of spring 138 to catch in the closed position and to be released by again pushing the cap down and releasing.

In basin waste 110, the top cap 128 is a push fit on the movable plug component and is retained thereon by engagement of the inner face of the cap with outwardly biased living clips 153 in the plug which is formed of a plastic material.

The foregoing description has been given by way of illustrative example of the invention and many modifications and variations which will be apparent to persons skilled in the art may be made without departing from the spirit and scope of the invention as defined by the appended claims.

The invention claimed is:

1. A bath or basin waste, including:

a tube defining a flow passage with an inlet at its upper end and an outlet at its lower end, said tube terminating at its upper end in an outwardly extending flange having an upper face and a lower face and said tube having a bridge extending across said flow passage intermediate said upper and lower ends;

a plug assembly mounted in an operative position in said flow passage, said plug assembly including a plug arranged for up and down movement relative to said tube between an open position in which said plug is up and a closed position in which it is down, said plug including an upper face which is substantially flush with the upper face of the flange when in the open position and below the upper face of the flange when in the closed position at least adjacent its periphery, said plug assembly further including actuation means mounted in said flow passage and connected to said plug for actuating movement of said plug relative to said tube between the closed position and the open position, said plug assembly being engaged with said bridge such that in use it is retained in its operative position in said flow passage only by gravity whereby it can be removed from said flow passage by lifting it from said bridge.

2. A bath or basin waste, including:

a tube defining a flow passage with an inlet at its upper end and an outlet at its lower end, said tube terminating at its upper end in an outwardly extending flange having an upper face and a lower face and said tube having a support means for supporting a plug assembly extending across said flow passage intermediate said upper and lower ends;

a plug assembly supported in an operative position in said flow passage by said support means, said plug assembly including a plug arranged for up and down movement relative to said tube between an open position in which said plug is up and a closed position in which it is down, said plug including an upper face which is substantially flush with the upper face of said flange when in the open position and below the upper face of the flange when in the closed position at least adjacent its periphery, said plug and said tube defining a space therebetween and said space being the only passage for flow between said inlet and said outlet when said plug is in the open position, said plug assembly further including actuation means mounted in said flow passage and connected to said plug for actuating movement of said plug relative to said tube between the closed position and the open position, said plug assembly including guide means arranged to guide said plug in generally linear up and down movement relative to said tube and to centralise said plug assembly in said tube when in the open position, and wherein said plug assembly being engaged with said support means for supporting a plug assembly in a sliding, non-threaded relationship such that in use it is retained in its operative position in said flow passage only by gravity whereby it can be removed from the flow passage by lifting it from said support means for supporting a plug assembly.

3. A bath or basin waste according claim 2 wherein said plug is adapted to sealably engage with the inner face of said tube to close the flow passage when in the closed position and to disengage from the inner face when in the open position so as to allow water to flow through said flow passage.

4. A bath or basin waste according to claim 3, wherein said plug includes an outwardly extending circumferential flange which engages with a circumferential flange extending inwardly from the inner face of said tube when in the closed position thereby closing said flow passage.

5. A bath or basin waste according to claim 2, wherein said guide means includes a plurality of circumferentially spaced ribs extending outwards from a centre portion.

6. A bath or basin waste according to claim 5 wherein said ribs are adapted to slidably engage in linear face of said tube in circumferentially spaced apart relationship so as to maintain said plug assembly aligned within said tube.

7. A bath or basin waste according to claim 2, wherein said actuation means is connected to said plug in a manner adapted to accommodate lateral forces applied to said plug by said actuating means so as to prevent said plug binding with said tube.

8. A bath or basin waste according to claim 7, wherein said actuation means is connected to said plug so as to allow relative pivoting movement between said plug and said actuation means.

9. A bath or basin waste according to claim 2 wherein said plug includes a sealing component and a top cap or top cap portion, said top cap or top cap portion together with said tube defining said space between said plug and said tube through which water can flow.

10. A bath or basin waste according to claim 9 wherein said space is an annular space which allows water to flow around said top cap or top cap portion.

11. A bath or basin waste according to claim 9 wherein said top cap or top cap portion has a skirt depending therefrom and said top cap or top cap portion is connected to said sealing component via said skirt.

12. A bath or basin waste according to claim 9, wherein said top cap is screwed onto said sealing component.

13. A bath or basin waste according to claim 2 wherein said support means for supporting a plug assembly is a bridge extending across said flow passage intermediate said upper and lower ends and said plug assembly is engaged with said bridge when in the operative position.

14. A bath or basin waste according to claim 13, wherein said support means for supporting a plug assembly includes a central bore and said plug assembly includes a centre spigot adapted to slidably engage in said bore and stop means arranged to engage said support means for supporting a plug assembly to define the limit of such engagement.

* * * * *